United States Patent [19]

Kerr, Jr.

[11] 4,368,452

[45] Jan. 11, 1983

[54] THERMAL PROTECTION OF ALUMINUM CONDUCTOR JUNCTIONS

[76] Inventor: Robert L. Kerr, Jr., 6532 W. Palm La., Phoenix, Ariz. 85035

[21] Appl. No.: 275,890

[22] Filed: Jun. 22, 1981

[51] Int. Cl.[3] ..... H01H 37/76

[52] U.S. Cl. ..... 337/414; 337/416; 339/147 R

[58] Field of Search ..... 337/292, 401, 412–416, 337/198, 199, 208, 187, 8; 339/275 T, DIG. 1

[56] References Cited

U.S. PATENT DOCUMENTS

| | | | |
|---|---|---|---|
| 3,180,958 | 4/1965 | Merrill | 337/413 |
| 3,236,976 | 2/1966 | Rayno | 337/292 |
| 3,304,396 | 2/1967 | Hasson | 337/414 |
| 3,360,623 | 12/1967 | Graziosi | 337/199 |
| 3,566,008 | 2/1971 | Ettlinger | 339/275 T |
| 3,585,555 | 6/1971 | Yamada | 337/198 |
| 3,708,611 | 1/1973 | Dinger | 339/DIG. 1 |
| 3,916,363 | 10/1975 | Jekai | 337/187 |

OTHER PUBLICATIONS

The Family Handiman, 217th Edition, pp. 20–22, 62, Mar. 1981.

*Primary Examiner*—William H. Beha, Jr.
*Attorney, Agent, or Firm*—James F. Duffy

[57] ABSTRACT

An electrical safety connector 10 provides a thermal linkage 12 between two female connectors 11. If a high resistance contact occurs at either connector 11, thermal linkage 12 melts and the molten material, of which thermal linkage 12 was comprised, flows under the influence of gravity to an expansion void 14 in an insulation sheath 13, thus interrupting current flow through connectors 11 and preventing the re-initiation of such current flow. Any potential fire hazard from the localized temperature rise at said high resistance contact is thereby eliminated. An alternate embodiment provides a male pigtail wire 17 for utilizing safety connector 10 in updating the wiring of early wired residences and other structures.

7 Claims, 6 Drawing Figures

THERMAL PROTECTION OF ALUMINUM CONDUCTOR JUNCTIONS

DESCRIPTION

1. Technical Field

The invention relates to the thermal protection of junctions made with aluminum wire conductors. In particular, the invention relates to connector devices having thermal linkages which are meltingly destroyed as a result of localized high temperatures experienced at the juncture of one or more conductors, one of which conductors may be aluminum.

2. Background Art

Past innovators have been quite active in providing thermally sensitive switches which will cause an interruption in the current carrying capacity of a circuit. Among the known prior art are U.S. Pat. No. 2,678,980, Hitchcock; U.S. Pat. No. 3,180,958, Merrill; U.S. Pat. No. 3,274,361, Ebensteiner et al; U.S. Pat. No. 3,304,396, Hasson; U.S. Pat. No. 3,821,685, Kimball et al; U.S. Pat. No. 4,025,889, Schwarz; and U.S. Pat. No. 4,075,595, Plasko. All of these devices require a spring loaded movement of elements in order to effect the interruption of the current carrying capacity of the circuit. With the exception of Hitchcock, all are concerned with rises in the ambient temperature of the surrounding environment in which the thermally sensitive switch is emplaced. With the exception of Hitchcock and Hasson, all require specialized, integral input and output line conductors.

Hasson provides the means of making a junction in external wiring and provides means whereby that junction may be interrupted by a rise in the ambient temperature of the environment. Hitchcock provides means for joining two external electrical conductors but, the device, rather than failing upon a rise in the ambient temperature of the environment, fails upon a rise in the temperature of the center conductor caused by excessive current drawn through that center conductor which excessive current exceeds the rated capacity of the center conductor and causes the $i^2r$ loss of the center conductor to grow so great as to cause a temperature rise sufficient to endanger the integrity of the insulating sheath of the center conductor.

U.S. patents issued to Graziosi, U.S. Pat. No. 3,360,623; and to Yamada, U.S. Pat. No. 3,585,555 concern over-current protection of female-type wall receptacles by use of fuses or resettable circuit breakers. No known protection devices protect such receptacles from localized hazardous temperature rise due to high resistance connections between the receptacle and the incoming power line.

While the prior art provides devices to protect sensitive equipment from hazardous rises in ambient temperature in the environment to which such circuitry is exposed, no protector devices are known which considers the danger of a poor splice or cable connection which can result in a fire hazard condition due to extreme rises in local temperatures at the defective splice or junction.

The use of aluminum wiring in homes and other building structures has been cited as the cause of fires which have wrecked havoc in such homes and structures. Aluminum wiring is subject to "cold flow". When stressed, the aluminum wire tends to move so as to eliminate the stress. Thus two aluminum wires which are twisted tightly together so as to form a sound, high conductive electrical splice will, over a period of time, experience cold flow so that the once tightly twisted wire pair becomes a relatively loosely twisted wire pair. This cold flow degrades the high conductivity characteristics of the original splice. The splice now is one of relatively high resistance. When the current carried by the conductor enters this area of high resistance, a power drop is experienced equivalent to the square of the current times the resistance presented by the splice. As time goes on, that resistance increases and there may be some localized arcing within the splice to further degrade the conductivity of the splice. Eventually, the heat developed by the power loss at the splice may cause the local temperature at the splice to rise so high as to ignite insulation material or nearby walls and woodwork.

In April of 1980 the ABC television news magazine "20/20" presented a report on aluminum electrical wiring. There it was noted that in homes built between 1965 and 1973 in which aluminum wiring was installed there was a danger that the insulation was not correct according to today's standards. Many of these homes had aluminum wiring in which pigtail splices were employed to join two conductors or where the aluminum wire was inserted under the screw head of a terminal board. As with the simple twist splice, aluminum cable under the stress of a terminal screw would could flow so as to produce a high resistance connection to the terminal of the terminal board. Once again, the dangers of fire due to extreme rises in the localized temerature at that terminal point was present.

To update older insulations, the U.S. Consumer Product Safety Commission advises that copper wire be used under terminal screws, that switches and outlet devices be replaced with those specifically designed to accept aluminum wiring and that, in general, copper wire be utilized in making the connection to any such terminal or switch device. In order to provide that copper wire be utilized to make the final connection, it is necessary that a short length of copper wire be spliced to the aluminum wire. The prescribed method for doing this is to use twist-on wire lock connectors or to use a small hollow cylinder of metal known to those skilled in the art as COPALUM compression connectors which are crimped utilizing a special tool and die to apply a high pressure to a small hollow in the cylinder so as to crimp the connector onto the wires. However, neither the twist-on wire lock connectors nor the COPALUM method is universally accepted at this time.

It is therefore an objective of the invention to provide a fire hazard protective device for use in joining aluminum wiring to either aluminum or copper wiring.

It is a specific objective of the invention that such device shall interrupt the flow of current when localized heating indicates that a high resistance connection exists.

It is a particular objective of the invention to provide an electrical connector which will provide a fire hazard preventive method of coupling aluminum wiring to wall receptacles, switches and the like.

It is a further objective of the invention to provide such fire protective improvements in wall receptacles and switches which themselves are often susceptible to dangerous localized high temperature excursions.

DISCLOSURE OF THE INVENTION

In an electrical connector having conduction means therethrough, an insulating envelope thereabout, and means for captivating the end of at least one exterior electrical conductor, the invention provides an improvement in the form of a thermal linkage coupled to the conduction means within the connector for reacting meltingly to thermal rather than current overloads so as to interrupt the conduction means through said electrical connector when a high resistance connection results between the end of the electrical conductor and the captivating means, which high resistance connection causes a localized, potentially dangerous high temperature rise. To prevent the molten thermal linkage from solidifying and bridging the interrupted conduction means so as to permit current to once more flow, an expansion void is provided into which the molten thermal linkage material moves under the influence of gravity alone unassisted by springs or other moving devices. When such an electrical connector is provided with means for captivating an exterior electrical conductor at either end, the connector provides a fire-hazard-safe connector for joining aluminum wiring to other aluminum wiring or to copper wiring.

If such a connector is utilized with an aluminum wire and has its other end permanently coupled to a short length of copper wire, the short copper wire acts as a plug which may be readily fitted to the self-locking, captivating wire connectors of today's wall receptacles and switches.

If such a connector is utilized to join a length of aluminum wire to a short length of copper wire, a fire-hazard-safe junction of the two wires is achieved and the short length of copper wire may be utilized for connection to wall receptacles, switches and terminal boards.

BEST MODE FOR CARRYING OUT THE INVENTION

Figure 1:
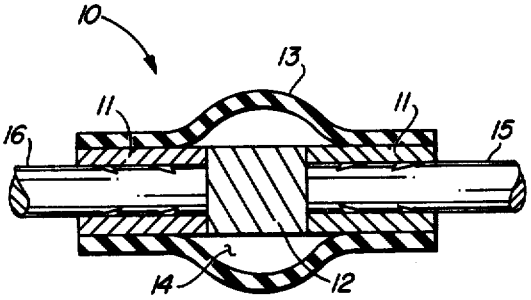
FIG. 1 illustrates an improved electrical connector having a thermal linkage which melts upon a localized rise in temperature due to a high resistance connection with the conductors coupled by the connector. An expansion void provides space for the accumulation of molten material from the thermal linkage to prevent bridging of the conductor surface by said thermal linkage material.

AMP Special Industries of Valley Forge, Pa. has a program for updating residences which were wired with aluminum wiring in the years between 1965 and 1973. The program comprises the splicing of copper-wire pigtails to aluminum wire using the AMP COPALUM safety connectors and AMP heat shrink tubing. As noted earlier, the COPALUM safety connector is a hollow tube into which the wires are inserted and the tube is then crimp-fit to the wires to form a splice. The splice is then covered with a heat shrink tube and heat applied to shrink the tubing to provide the necessary insulation over the new splice. The copper pigtail is then utilized to make the connection to terminal strips, switches, receptacles and the like.

As also noted earlier, twist-on wire nuts have also been utilized to make the copper pigtail for connections as already indicated. Neither the COPALUM safety connector nor the twist-on wire nut is universally accepted. Both have been known to fail.

The instant invention provides an electrical connector which, while not proclaiming that splices and wire junctions will inevitably fail, recognizes the possibility of failure and fire hazard due to a high resistance wire junction.

For expository purposes, the connectors illustrated in the drawings present a self-locking connector. It will be readily understood by those skilled in the art that a crimp-type connector may be readily adapted to the safety connector of the invention.

The safety connector disclosed herein is referred to generally by the reference 10. In general, the connector comprises two self-locking female connectors 11 coupled together by a conductive thermal linkage 12. An insulating sheath 13 envelops the connector and is expanded in its central region to provide an expansion void 14. Wires of differing materials may be connected by means of safety connector 10. For example, wire 15 may be an aluminum conductor wire while wire 16 may be a copper wire. It will be readily apparent that wires 15 and 16 may both be of the same material thus, they may both be copper conductors or both may be aluminum conductors.

If the connection made by either of wires 15 or 16 with connector 10 should prove to be a high resistance connection subject to overheating under current load, the highly localized temperature rise within connector 10 will cause thermal linkage 12 to melt. The molten material of which thermal linkage 12 is comprised will flow under the influence of gravity into expansion void 14. Expansion void 14 is of such a size as to prevent the molten material from bridging between female connectors 11 and so, again completing the circuit.

With the conductive coupling between female connectors 11 interrupted, no further rise in temperature will be experienced within the safety connector. The current load will have then interrupted as well, and the danger of fire hazard removed.

As those skilled in the art will well recognize, insulative sheath 13 may be comprised of a material which will discolor when the molten material of which thermal linkage 12 is comprised comes into contact therewith. The discolored sheath 13 then provides a tell-tale to provide a visual indication of the point at which repairs must be made.

Figure 2:
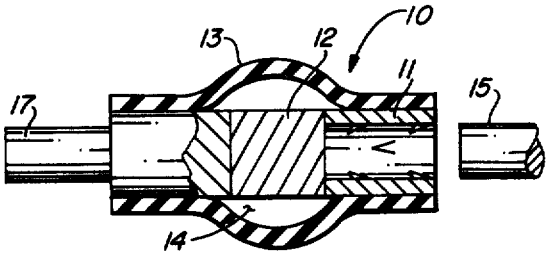
FIG. 2 illustrates an improved connector having a permanently coupled copper wire plug which may be utilized for connecting same to wall receptacles, switches, or terminal boards.

The safety connector of FIG. 1 may be readily adapted to the pigtail conversion program for updating homes wired with aluminum wiring between the years 1965 and 1973. For this purpose, wire referenced 15 may be considered the aluminum wiring of the house while the wire referenced 16 may be a short length of copper wire to be used as the pigtail wire for connection to terminals, receptacles, switches and the like. Alternatively, a safety connector adapted as shown in FIG. 2 might be provided to satisfy the pigtail conversion of the earlier aluminum wired home installations. Thus, in FIG. 2, the wire 15 may again represent the aluminum of the home while a permanent copper pigtail 17 is incorporated within the safety connector 10 at the time of its manufacture.

Figure 3:
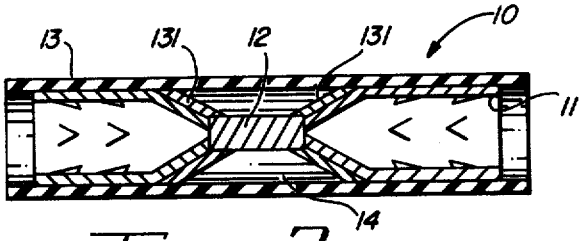
FIG. 3 illustrates an alternate embodiment of the connector of FIG. 1 in which the expansion void in which the molten linkage material accumulates is provided without the necessity of having to enlarge the diameter of the connector in that region.

An alternate embodiment of safety connector 10 is presented in FIG. 3. Here, the expansion void 14, is provided without increasing the diameter of sheath 13. To this end, female connectors 11 are tapered to their point of coupling with thermal linkage 12. This tapered section is then enveloped in an insulated sheath 131. This tapered sheath 131 is in addition to conventional outer insulated sheath 13. When the connector 10 of FIG. 3 is utilized with conductors which, due to a high resistance connection, cause a localized high rise in temperature, thermal linkage 12 will melt as earlier described and move under the influence of gravity into the void 14. The tapered insulated sheath 131 will prevent the molten material of thermal linkage 12 from bridging between female connectors 11 and thus, reforming the circuit. As with the connectors of FIGS. 1 and 2, once the circuit has been interrupted, it will remain that way thus eliminating any fire hazard which may have existed at the point of the high temperature rise.

Figure 4A:
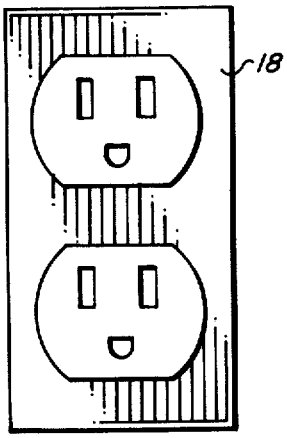
FIGS. 4A–4C illustrates a modified wall receptacle having thermal linkages to protect against fire hazards resulting from localized temperature increases due to high resistance connections.
Figure 4B:
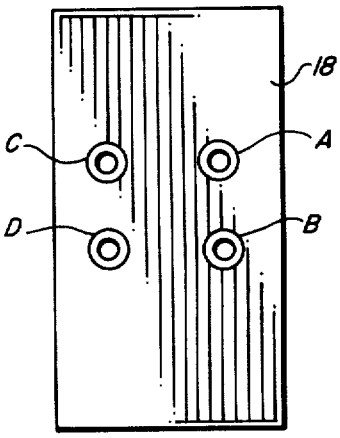
Figure 4C:
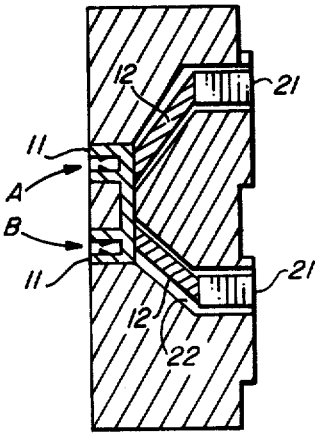

FIGS. 4A–C illustrate a three-wire wall receptacle of conventional outline. FIG. 4A illustrates the face of the three-wire connector normally exposed to view when the receptacle is mounted in the wall. FIG. 4B illustrates the openings in the wall of the receptacle to permit the entry of electrical wiring wherein the wiring is captivated to form an electrical connection.

FIG. 4C is a sectional view of the receptacle of FIGS. 4A and 4B taken along a plane through the openings A and B in the insulative body 18 of the three-wire wall receptacle. FIG. 4C illustrates the self-locking female connectors 11 coupled to conductive thermal linkages 12 which are in turn connected to female contacts 21 of standard design and characteristic. Wall receptacles are subject to two forms of high resistance joints either of which may lead to fire hazard. First of these is a high resistance connection at female connector 11 wherein the current carrying wire is locked into the wall receptacle. The second source of a high resistance connection sometimes occurs at the point at which the male plug, not shown, makes contact with the female connector 21 of the wall receptacle. The improved receptacle illustrated in 4C will prevent such high resistance contacts from providing fire hazards since the localized rise in temperature due to such high resistance connections will cause thermal linkage 12 to melt, thus interrupting the current path and preventing any further rise in temperature. An expansion void 22 accepts the molten material from thermal linkage 12 which flows under the influence of gravity alone. The normal downward slope of expansion voids 22 assures that the molten material of linkages 12 will not later bridge the gap between connectors 11 and 21 and thus re-connect connectors 11 and 21.

What has been disclosed is an electrical safety connector providing a thermal linkage between two female connectors. If a high resistance contact occurs at either of the female connectors, the thermal linkage will melt and eliminate any potential danger of fire from the localized high temperature rise. An alternate embodiment of the invention provides a male pigtail wire for utilizing the safety connector in updating the wiring systems of homes wired with aluminum wire during the years of 1965 through 1973.

Those skilled in the art will derive other embodiments drawn from the teachings herein. To the extent that such embodiments are so drawn, it is intended that such embodiments will fall within the ambit of protection provided by the claims set forth hereinafter.

Having described my invention in the foregoing specification and the drawings accompanying it in such a clear and concise manner that those skilled in the art may readily and easily practice the invention, I claim that which is set forth in the following claims.

I claim:

1. In an electrical connector having conduction means therethrough, an insulating envelope thereabout, and means for captivating the end of at least one exterior electrical conductor, the improvement comprising:

thermal linkage means coupled to said conduction means for reacting meltingly to thermal rather than current overloads to interrupt said conduction means through said electrical connector when a high resistance connection results between the end of said exterior conductor and said captivating means causing a localized, potentially dangerous high temperature rise; and an expansion void to which said thermal linkage means moves in its molten state under the influence of gravity alone so that said conduction means remains interrupted.

2. The improved connector of claim 1 further comprising second means for captivating the end of at least a second exterior electrical conductor said first exterior conductor comprising an aluminum conductor, said second exterior electrical conductor comprising at least one of an aluminum conductor and a copper conductor wherein said improved connector provides a fire protective means for joining an aluminum conductor to other conductors.

3. The improved connector of claim 1 further comprising:

a copper conductive plug coupled to said conductive means and adapted for connection to electrical fixtures having self-locking captivating wire connectors.

4. The improved electrical connector of claim 1 wherein said electrical connector comprises a wall mounted electrical fixture.

5. The improved electrical connector of claim 4 wherein said wall mounted electrical fixture comprises a female wall receptacle.

6. The improved connector of claim 1 further comprising a copper conductive pigtail wire coupled to said conductive means and adapted for connection to electrical fixtures designed for use with copper wire.

7. The improved connector of claim 1 wherein said insulating envelope comprises a material which discolors when subjected to high temperature contact of said thermal linkage means in its molten state.

* * * * *